US005851308A

United States Patent [19]

Engelking et al.

[11] Patent Number: 5,851,308

[45] Date of Patent: Dec. 22, 1998

[54] ACID BOTTLE WASHING APPARATUS AND METHOD

[75] Inventors: Steven Engelking; Robert R. Sanchez, both of San Antonio, Tex.

[73] Assignees: Sony Corporation, Japan; Sony Electronics, Inc., Park Ridge, N.J.

[21] Appl. No.: 861,020

[22] Filed: May 21, 1997

Related U.S. Application Data

[62] Division of Ser. No. 493,313, Jun. 21, 1995, Pat. No. 5,720,307.

[51] Int. Cl.[6] ..... B08B 3/02; B08B 9/00

[52] U.S. Cl. ..... 134/22.17; 134/22.18; 134/27; 134/28; 134/29

[58] Field of Search ..... 134/22.17, 22.1, 134/22.18, 26, 27, 28, 29

[56] References Cited

U.S. PATENT DOCUMENTS

| | | | |
|---|---|---|---|
| 54,538 | 5/1866 | Harvey | 134/27 |
| 1,272,917 | 7/1918 | Cooke | 134/27 |
| 1,642,419 | 9/1927 | Loew | 134/22.17 |
| 1,816,881 | 8/1931 | Warnke | 134/27 |
| 1,827,223 | 10/1931 | Dennis | 134/27 |
| 1,902,815 | 3/1933 | Goodhue | 134/27 |
| 2,043,300 | 6/1936 | Mcdorman | 134/27 |
| 2,291,085 | 7/1942 | Lehmkuhl et al. | 134/27 |
| 2,338,045 | 12/1943 | Leonard | 134/27 |
| 2,916,406 | 12/1959 | Bulatkin | 134/22.17 |
| 3,670,929 | 6/1972 | Berry | 222/400.7 |

*Primary Examiner*—Jill Warden
*Assistant Examiner*—Saeed Chaudhry
*Attorney, Agent, or Firm*—Ronald P. Kananen

[57] ABSTRACT

In order to quickly and inexpensively rinse recyclable acid bottles which contain acid residues or decontaminate pieces of apparatus which are contaminated with acid, the interior of the bottles or apparatus is rinsed with an alkaline solution and then with water. The exterior of the bottles or apparatus is rinsed with water. The alkaline solution is stored in fiberglass canisters and is displaced to spray nozzles by the application of air under pressure. Valves which control the supply of water and alkaline solution are controlled by either solenoids or by air-activated devices. In the case of air-activated valves the air under pressure which is used to force the alkaline solution toward the spray nozzles can be used to operate the valves.

6 Claims, 3 Drawing Sheets

ACID BOTTLE WASHING APPARATUS AND METHOD

This application is a division of application Ser. No. 08/493,313 filed Jun. 21, 1995 U.S. Pat. No. 5,720,307.

BACKGROUND OF THE INVENTION

1. Field of the Invention

The present invention relates generally to a bottle washing apparatus and method. More specifically, the present invention relates to a bottle washing arrangement which utilizes alkaline solutions and which is suited to rinsing acid bottles or pieces of apparatus which are contaminated with acid residues.

2. Description of the Related Art

In order to conserve the environment, recycling of various material such as plastic is being given extensive consideration and is being carried out in many industrial applications. In certain industries, large amounts of acid are used. The acid is often supplied in plastic bottles which can be recycled. However, it was observed that the bins, usually wooden, in which the spent plastic bottles are stored for pick-up by the recycler are often marked with acid burns irrespective of the fact that the bottles are washed before being placed in the bins. The acid which apparently remains in the bottles after washing is thus a hazard to the people involved with the recycling operation, so it has been proposed to increase the bottle washing time. However, this proposal has led to a situation wherein the washing period has become excessively long and not completely effective, even after a 15 to 30 minute washing cycle, since some acid remains.

More specifically, current acid bottle washers do not adequately neutralize the residues in acid bottles inasmuch as they rely exclusively on water to rinse the interior of the containers. Certain types of acid such as hydrofluoric and nitric acids form crystals that are difficult if not impossible to dislodge even with lengthy rinsing.

Depending on the industry, there can thus be hundreds of bottles which must be processed each day, so that the problem is considerable.

SUMMARY OF THE INVENTION

It is an object of the present invention to provide a bottle washing apparatus and method which greatly reduce washing time for acid bottles and which eliminate hazards associated with handling such bottles which contain residual acid, acid residues, and the like.

It is a further object to provide a washing arrangement which can decontaminate acid-contaminated filters and the like type of apparatus.

In brief, in order to quickly and inexpensively rinse recycleable acid bottles which contain acid residues or decontaminate pieces of apparatus which are contaminated with acid, the present invention provides an arrangement by way of which the interior of the bottles or apparatus is rinsed with an alkaline solution and then with water. The exterior of the bottles or apparatus is rinsed with water. The alkaline solution is stored in fiberglass canisters and is displaced to spray nozzles by the application of air under pressure. Valves which control the supply of water and alkaline solution are controlled either by solenoids or by air-activated devices. In the case of air-activated valves, the air under pressure which is used to force the alkaline solution toward the spray nozzles can be used to operate the valves.

More specifically, a first aspect of the present invention resides in an apparatus for washing an article having an acid residue comprising: a source of alkaline solution for neutralizing the acid residue; a source of water for rinsing the article; first valve means for selectively controlling the supply of water to a plurality of first nozzles and a plurality of second nozzles; and second valve means for selectively supplying alkaline solution to the second nozzle means.

A second aspect of the present invention resides in a decontaminating apparatus for articles contaminated with acid residues comprising: a source of alkaline solution; a source of water; first valve means for selectively controlling the supply of water to a plurality of first nozzle means and to a plurality of second nozzle means; and second valve means for selectively supplying alkaline solution to the second nozzle means in lieu of water.

A third aspect of the invention resides in a method of decontaminating articles which are contaminated with acid residue comprising the steps of: displacing an alkaline solution from a canister arrangement and spraying the alkaline solution on a predetermined portion of the article to be decontaminated; rinsing the predetermined portion of the article with water; and rinsing a second predetermined portion of the article with water.

BRIEF DESCRIPTION OF THE DRAWINGS

The various advantages and merits of the present invention will become more clearly understood as the following written description of the preferred embodiment is made with reference to appended drawings in which.

DETAILED DESCRIPTION OF THE PREFERRED EMBODIMENTS

Figure 1:
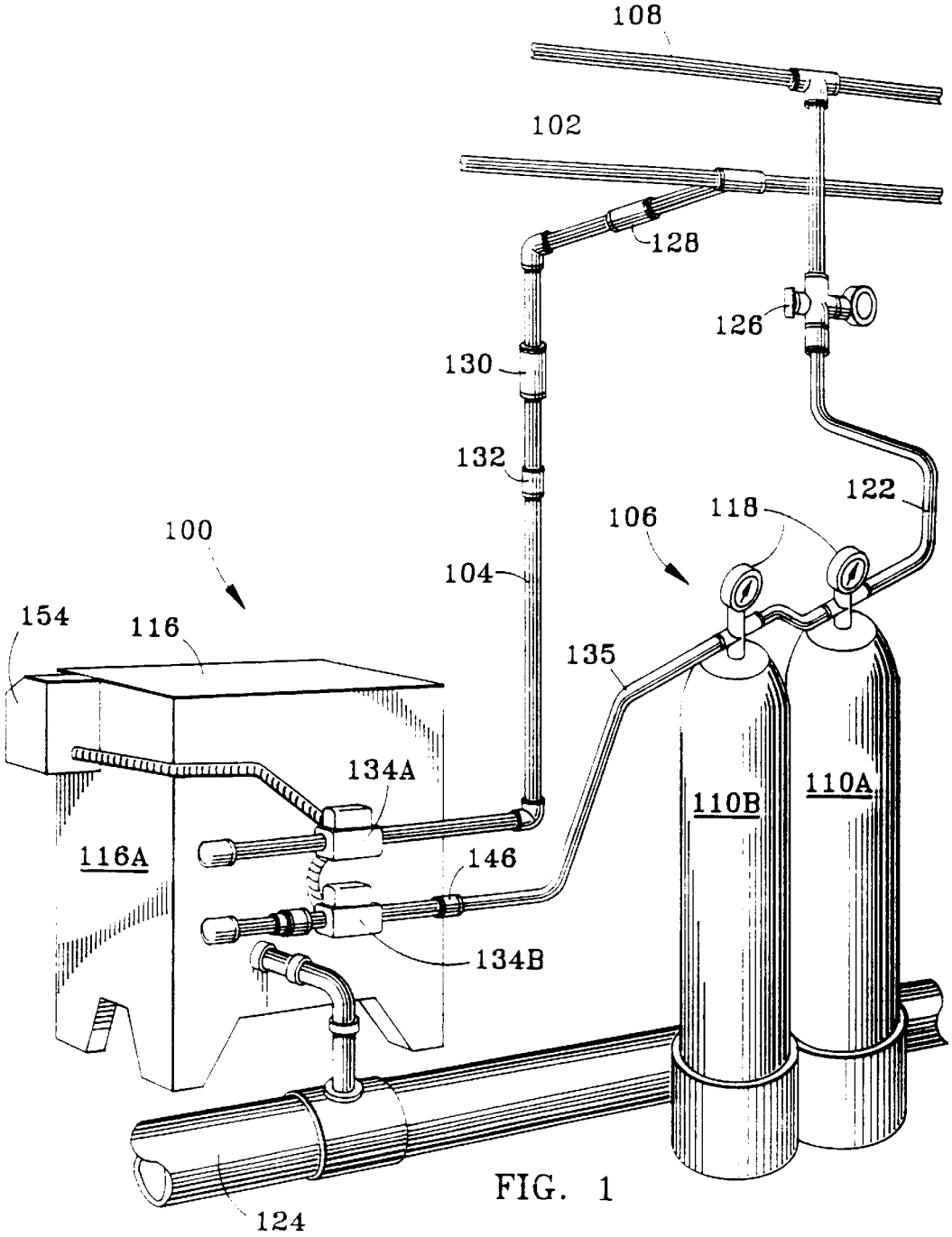
FIG. 1 is a perspective view showing the present invention applied to a commercially available bottle washing apparatus.
Figure 2:
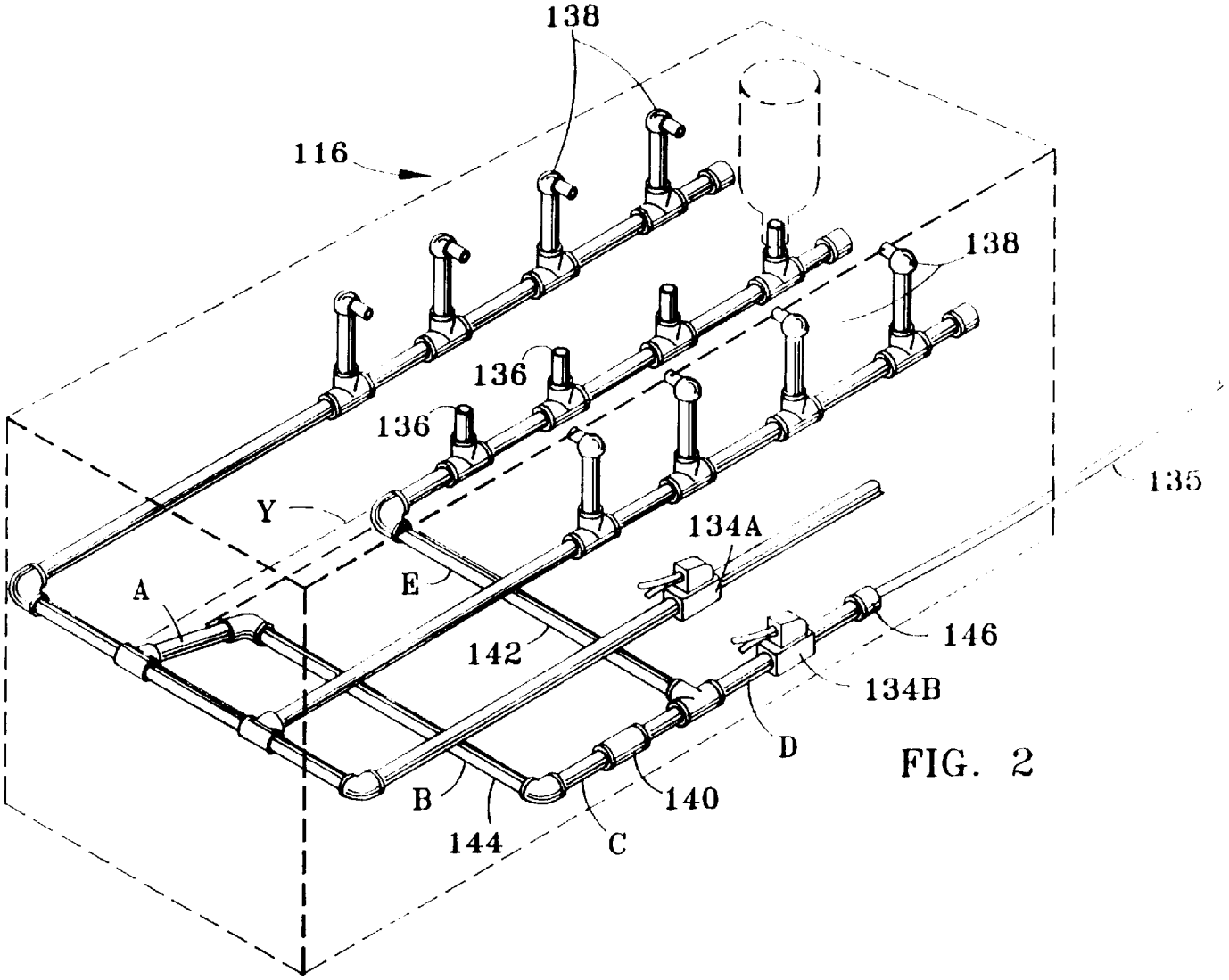
FIG. 2 is a perspective view showing a conduit arrangement which enables the present invention to be applied to the bottle washing apparatus shown in FIG. 1.
Figure 3:
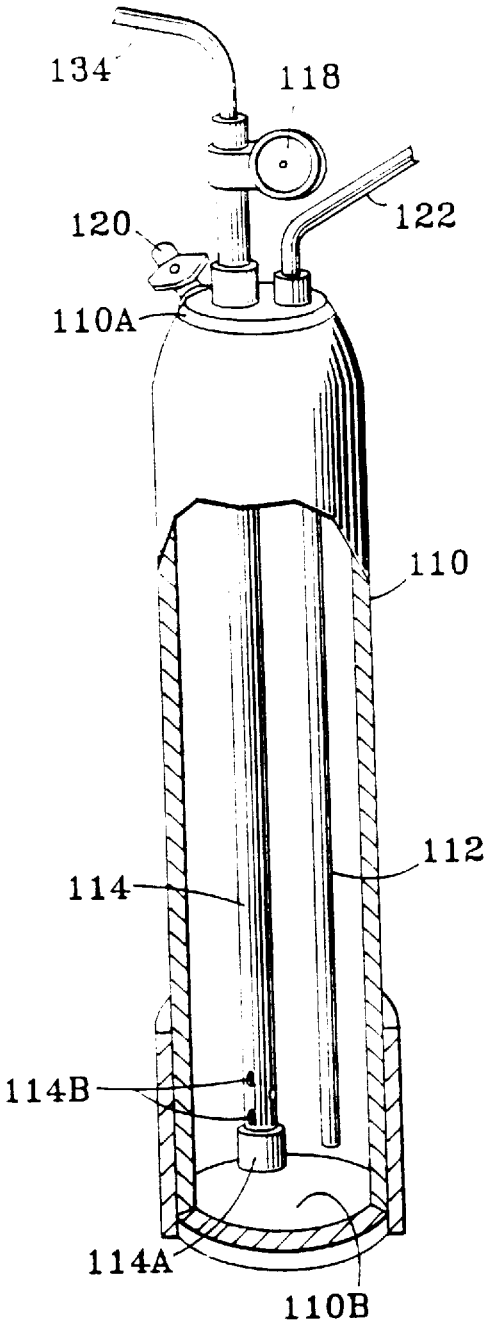
FIG. 3 is a partially cut-away view showing a container in which liquid for use in the present invention is stored.

FIGS. 1 to 3 show an embodiment of the invention.

In this arrangement, a bottle washing apparatus 100 is connected with a source of industrial cold water (I.C.W.) 102 through a water supply line 104. In the arrangement shown, the water can be under a pressure of about 75 psi. A source 106 of an aqueous solution of an alkaline material such as triethanolamine, sodium hydroxide, or sodium carbonate is operatively connected with a source of clean dry air (C.D.A.) 108. In accordance with this embodiment of the invention, the alkaline material is suitably dissolved in water and placed in fiberglass canisters 110A, 110B.

As shown in FIG. 3, each canister 110 is provided with an air pressure supply conduit 112 which leads from the top 110*a* of the canister 110 to a location proximate the bottom or base 110*b* of the canister 110. A neutralizer supply tube 114 leads from the bottom 110*b* of the canister 110 to the top 110*a* for conveying the neutralizing liquid to the washing apparatus 116. In the illustrated arrangement, the neutralizer supply tube 114 is provided with a cap 114*a* to prevent sediment, which is stirred and agitated by air introduced into the canister 110 through the air pressure supply conduit 112, from being forced into the washing apparatus 116 (FIG. 1). To permit the liquid in the canisters 110 to be displaced into the supply tube 114, a plurality of openings 114*b* are provided at locations near the lower end of the supply tube 114. By limiting the diameter of the openings 114*b*, a filtering effect which excludes large particles apt to clog the nozzles in the washing apparatus can be effected. Alternatively, a mesh filter or the like can be provided to exclude particulate matter.

A pressure gauge 118 is provided on each of the supply tubes 114 in the manner illustrated in FIG. 3. A bleed valve 120 is provided at the upper end of each canister 110 to permit venting of excess pressure if required and also to facilitate the refilling of the canister with alkaline solution.

In FIG. 1, two canisters 110A, 110B are shown serially connected wherein, instead of air being supplied into the air pressure supply conduit 112 of the second canister 110B, the liquid discharged from the first canister 110A is provided into the second canister 110B by way of the pressure supply conduit 112 and is used to displace the liquid in the second canister 110B in lieu of air. This arrangement permits a simplification in the conduiting arrangement and tends to unify the concentration of alkaline material which is actually supplied to the washing apparatus. The first canister 110A is connected with the source of clean dry air (C.D.A.) 108 under a pressure of about 115 psi by way of a C.D.A supply line 122.

The effluent from the bottle washing apparatus 116 is drained into an acid waste conduit 124.

In order to control the operation of the illustrated apparatus, the air pressure supplied to the leading canister 110A is controlled by a pressure regulator 126 while the supply of I.C.W 102 is controlled by a cut-off valve 128, a backflow preventer 130 and a check valve 132. Solenoid valves 134A, 134B are provided at the downstream ends of the I.C.W supply line 104 and a neutralizer supply line 135.

As best seen in FIG. 2 the bottle washing apparatus 116 includes two sets of nozzles. The first set of interior rinse nozzles 136 are arranged to direct jets of liquid into the interior of the bottles (only one is illustrated) and the second set of fine spray rinse nozzles 138 are arranged to direct sprays of water against the exterior of the bottles. As will be appreciated from the connections shown in FIG. 2, the second set of nozzles 138 is arranged to be supplied only with water while the first set of interior rinse nozzles 136 is arranged to be selectively supplied with either neutralizer or water or a mixture of water and neutralizer. This arrangement is achieved through the use of a check valve 140 which is arranged to permit water to be supplied into a conduit 142 but prevent neutralizer being permitted to pass into conduit 144. By continuously opening a water supply control solenoid valve 134A and continuously closing the neutralizer supply control solenoid valve 134B, water alone can be supplied to all of the nozzles 136, 138. By reversing the valve settings wherein the supply of water is cut-off by closing the water supply control valve 134A and the supply of neutralizer is permitted by opening the neutralizer supply control valve 134B, neutralizer can be injected into the interior of bottles which are placed thereover.

By regulating the pressure which is supplied to the canisters 110A, 110 from the pressure regulator 126, it is possible to ensure that the pressure with which the neutralizer is supplied is higher than the water pressure and thus establish a condition wherein the pressure differential across the check valve 140 is such that water is prevented from flowing through the valve in the direction of the arrow even if both of the water and neutralizer control solenoid valves 134A, 134B are simultaneously opened through some inadvertent misoperation. In order to further ensure that water is not permitted to flow back through conduit 135 toward the cannisters 110A, 110B, a check valve 146 disposed in conduit 135 in the illustrated location.

The operation of this embodiment is such that washing/decontamination is achieved using a single high pressure burst of a neutralizing solution having the highest pH possible with a water rinse before and after. Residues of neutralizer solution which remain in the nozzles 136 and the conduits 142 after the burst of neutralizing solution, will be flushed out in the final rinse and thus avoid the possibility of the nozzles 136 becoming clogged with deposits of soda ash or the like.

The arrangement illustrated in FIG. 2 is a modification of a commercially available bottle washing apparatus manufactured by Leatherwood Plastics of Lewisville, Tex. This modification is achieved by removing a portion of a conduit Y illustrated in broken line and introducing the conduits denoted by A, B, C, D and E along with the provisions of the solenoid valves 134A, 134B.

A controller 154 for the solenoid valves is mounted on the side of bottle washer cabinet 116A. This controller 154 can be either manual or automatic. It is within the scope of the invention to provide a control program for controlling the operation of at least the solenoids so as to render the process either fully or semi-automatic. The various possibilities via which the rinse time of the bottles can be shortened or the programs which would enable the best combination of solenoid operations to be developed is believed to be well within the purview of the person skilled in the art to which the present invention pertains given the concept which is set forth in this disclosure, and as such no further discussion will be given for brevity.

As mentioned above, it is possible to use alkaline materials such as triethanolamine, sodium hydroxide (caustic soda) or sodium carbonate. While caustic soda or sodium carbonate are preferred from the viewpoint of cost and are more caustic than triethanolamine, the invention is not limited to these two materials and it is within the scope of the present invention to use other materials or mixtures of one or both of the above mentioned alkaline materials with very small amounts of other materials such as surface active materials which promote wetting or the like.

The present invention is not limited to bottle washing and it is within the purview of the present invention to apply this technique to washing arrangements for "en situ" decontaminating heating elements and filters in Fab acid sinks. The present invention is not limited to the use of solenoid valves and any suitable form of valve can be envisaged. For example, as a source of C.D.A under 115 psi is readily available, air-activated valves can be used if desired. In this latter mentioned instance, it will be noted that, while maximum pressure for fiberglass canisters is normally 150 psi and the canisters are tested at 500 psi, the above-mentioned air-activated valves can only handle pressures of about 80 psi. Accordingly, the pressure in the canisters is limited to about half their allowed pressure in the event that air-activated valves are used. The provision of the pressure gauges 118 of course facilitates this type of checking and control.

The use of air-activated valves reduces the amount of electrical work that needs to be done in order to render the system operative and could be employed to reduce system set up costs.

Additional check valves can be used if desired to ensure that neutralizer solution is not caused to back-up in the event of a valve failure or malfunction. Alternatively, it is possible that the backflow preventer 130, shown in FIG. 1, can be omitted in that the arrangement shown in FIG. 2 already provides this function.

Although only one embodiment of the present invention has been discussed in detail, it will be appreciated in light of the above discussions that various modifications and changes are possible without departing from the scope of the invention which is limited only by the appended claims. For example, as mentioned above, it is well within the scope of the invention to apply the acid decontaminating technique which characterizes the present invention to pieces of apparatus such as heating elements and filters used in Fab acid sinks.

What is claimed is:

1. A method of decontaminating articles which are contaminated with acid residue comprising the steps of:

displacing an alkaline solution from a canister;

directing the alkaline solution into a washing apparatus wherein the articles to be decontaminated are located, and to first nozzles;

preventing the alkaline solution from flowing to second nozzles;

spraying the alkaline solution with the first nozzles on a first predetermined portion of the articles to be decontaminated;

directing water into the washing apparatus, and to the first and second nozzles;

rinsing the predetermined portion of the article with water using the first nozzles;

rinsing a second predetermined portion of the article with water using the second nozzles.

2. A method as set forth in claim 1, further comprising preventing the water from flowing into a supply line from which the alkaline solution is directed to the washing apparatus.

3. A method as set forth in claim 1, further comprising securing the articles to be decontaminated using the first nozzles.

4. A method as set forth in claim 1, further comprising filtering alkaline particulates from the alkaline solution prior to displacing the alkaline solution from the canister.

5. A method as set forth in claim 1, further comprising:

directing the alkaline solution displaced from the canister into a second canister containing additional alkaline solution, prior to directing the alkaline solution into a washing apparatus; and displacing the alkaline solution from the second canister.

6. A method as set forth in claim 1, wherein said step of displacing alkaline solution comprises using air under pressure to displace the alkaline solution out of said canister.

* * * * *